US012305366B2

(12) United States Patent
Yamamoto

(10) Patent No.: US 12,305,366 B2
(45) Date of Patent: May 20, 2025

(54) SHOVEL

(71) Applicant: SUMITOMO CONSTRUCTION MACHINERY CO., LTD., Tokyo (JP)

(72) Inventor: Takashi Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 854 days.

(21) Appl. No.: 17/448,964

(22) Filed: Sep. 27, 2021

(65) Prior Publication Data

US 2022/0010530 A1 Jan. 13, 2022

Related U.S. Application Data

(63) Continuation of application No. PCT/JP2020/011622, filed on Mar. 17, 2020.

(30) Foreign Application Priority Data

Mar. 30, 2019 (JP) ..... 2019-069474

(51) Int. Cl.
*E02F 9/22* (2006.01)

(52) U.S. Cl.
CPC ..... *E02F 9/2296* (2013.01); *E02F 9/2232* (2013.01)

(58) Field of Classification Search
CPC ..... F15B 11/17; F15B 21/082; F15B 2211/6346; F15B 2211/6658; F15B 2211/88; E02F 9/2232; E02F 9/2296; E02F 9/2235; E02F 9/2242; E02F 9/2228
See application file for complete search history.

(56) References Cited

U.S. PATENT DOCUMENTS 5,307,631 A 5/1994 Tatsumi et al.
10,100,847 B2 * 10/2018 Wu ..... F15B 11/08
2007/0181361 A1 8/2007 Stratton
(Continued)

FOREIGN PATENT DOCUMENTS

JP H05-079502 3/1993
JP 08296603 A * 11/1996 ..... E02F 9/2235
(Continued)

OTHER PUBLICATIONS

International Search Report for PCT/JP2020/011622 mailed on Jun. 9, 2020.

*Primary Examiner* — Thomas E Lazo
(74) *Attorney, Agent, or Firm* — IPUSA, PLLC

(57) ABSTRACT

A shovel includes a lower traveling body, an upper turning body turnably mounted on the lower traveling body, an attachment including a boom and an arm, a boom cylinder configured to drive the boom, an arm cylinder configured to drive the arm, a hydraulic pump configured to supply hydraulic oil to the boom cylinder and the arm cylinder, an input device configured to receive an input from a user, and a control device configured to control the hydraulic pump. The boom is attached to the upper turning body, and the arm is attached to a tip of the boom. When a predetermined work mode for performing hoisting work involving use of the attachment is selected in response to the input received by the input device, the control device sets a standby flow rate of the hydraulic pump to be greater than when the predetermined work mode is not selected.

9 Claims, 5 Drawing Sheets

(56) References Cited

U.S. PATENT DOCUMENTS

| | | | | |
|---|---|---|---|---|
| 2007/0205026 | A1* | 9/2007 | Lee | F15B 11/167 180/6.48 |
| 2014/0039768 | A1* | 2/2014 | Sawada | E02F 9/22 701/50 |
| 2015/0040552 | A1* | 2/2015 | Hashimoto | E02F 9/2242 60/429 |
| 2015/0204359 | A1* | 7/2015 | Wu | F15B 15/08 60/428 |
| 2015/0368880 | A1* | 12/2015 | Lee | E02F 9/2242 60/420 |
| 2017/0130428 | A1* | 5/2017 | Matsuzaki | E02F 9/2246 |
| 2019/0186105 | A1* | 6/2019 | Imura | E02F 9/22 |
| 2021/0207342 | A1* | 7/2021 | Morikawa | E02F 9/2004 |

FOREIGN PATENT DOCUMENTS

| | | |
|---|---|---|
| JP | H08-296603 | 11/1996 |
| JP | 2002-129602 | 5/2002 |
| JP | 2018-044414 | 3/2018 |
| JP | 2018-062412 | 4/2018 |

* cited by examiner

SHOVEL

CROSS-REFERENCE TO RELATED APPLICATION

The present application is a continuation of International Application No. PCT/JP2020/011622, filed on Mar. 17, 2020, which claims priority to Japanese Application No. JP2019-069474, filed on Mar. 30, 2019, the entire content of each of which is incorporated herein by reference.

BACKGROUND

Technical Field

The disclosures herein relate to a shovel.

Description of Related Art

In the related art, a technology that improves the turning operability of an upper turning body during hoisting work (may also be referred to as "crane work") that uses the attachment of a shovel is known.

SUMMARY

According to an embodiment of the present invention, a shovel includes a lower traveling body, an upper turning body turnably mounted on the lower traveling body, an attachment including a boom and an arm, a boom cylinder configured to drive the boom, an arm cylinder configured to drive the arm, a hydraulic pump configured to supply hydraulic oil to the boom cylinder and the arm cylinder, an input device configured to receive an input from a user, and a control device configured to control the hydraulic pump. The boom is attached to the upper turning body, and the arm is attached to a tip of the boom. When a predetermined work mode for performing hoisting work involving use of the attachment is selected in response to the input received by the input device, the control device sets a standby flow rate of the hydraulic pump to be greater than when the predetermined work mode is not selected.

BRIEF DESCRIPTION OF THE DRAWINGS

Other objects and further features of the present invention will be apparent from the following detailed description when read in conjunction with the accompanying drawings, in which.

DETAILED DESCRIPTION

In the related art, there is room for improvement in the operability of the attachment.

In view of the above, it is desirable to provide a technology that can further improve the operability of a shovel during hoisting work.

In the following, embodiments will be described with reference to the drawings.

[Outline of Shovel]

First, an outline of a shovel 100 according to an embodiment will be described with reference to FIG. 1.

Figure 1:
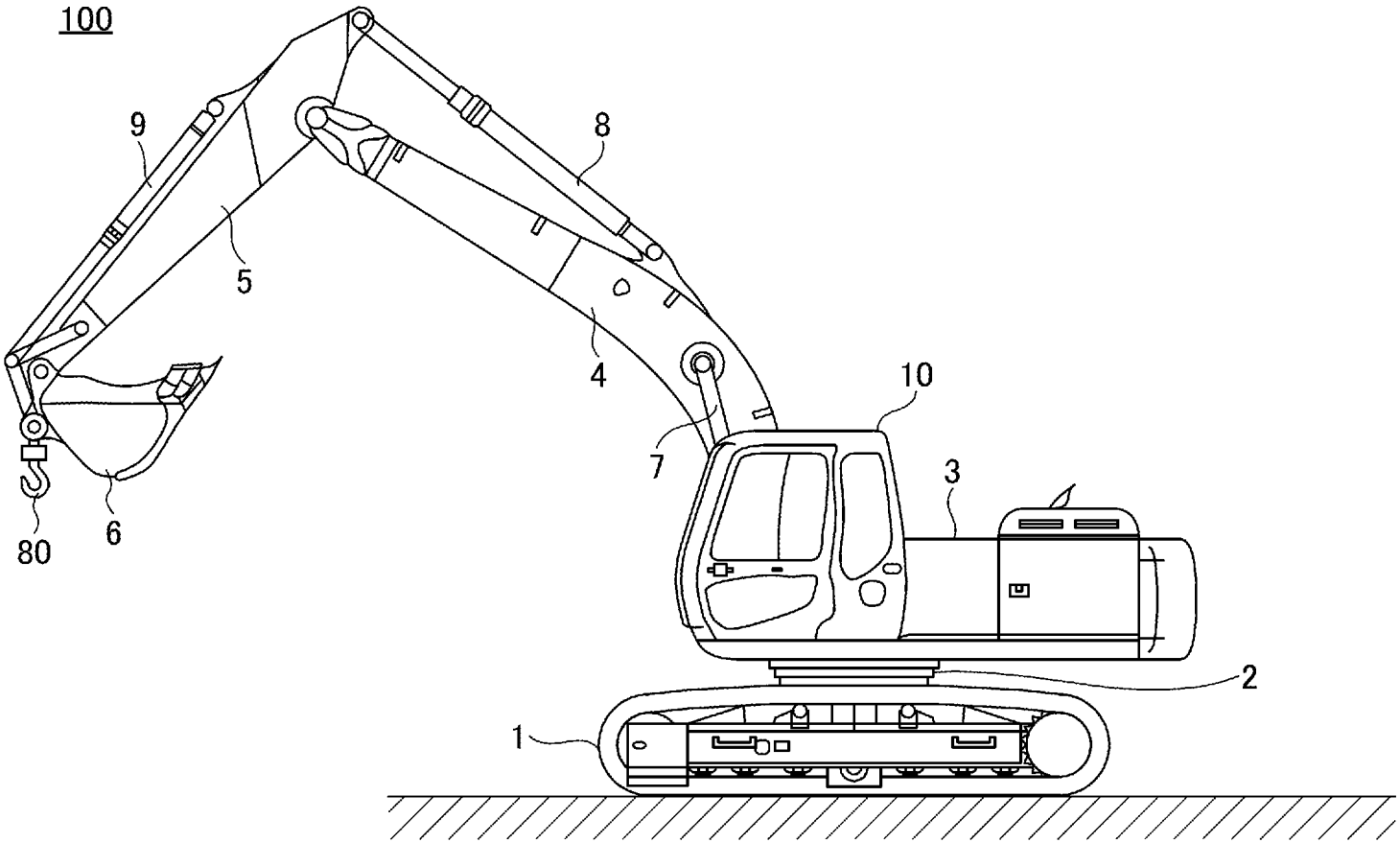
FIG. 1 is side view of a shovel.

FIG. 1 is a side view of the shovel 100 according to the embodiment.

The shovel 100 includes a lower traveling body 1, an upper turning body 3 turnably mounted on the lower traveling body 1 through a turning mechanism 2, a boom 4, an arm 5, a bucket 6, and a cabin 10. The boom 4, the arm 5, and the bucket 6 serve as an attachment (a work apparatus).

The lower traveling body 1 includes, for example, a pair of left and right crawlers, and the crawlers are hydraulically driven by respective traveling hydraulic motors 1L and 1R (see FIG. 2) to cause the shovel 100 to (autonomously) travel.

The upper turning body 3 is driven by a turning hydraulic motor 2A (see FIG. 2) to rotate relative to the lower traveling body 1.

The boom 4 is pivotably attached to the front center of the upper turning body 3 such that the boom 4 can be raised and lowered, the arm 5 is pivotably attached to the tip of the boom 4 such that the arm 5 can be turned upward and downward, and the bucket 6 is pivotably attached to the tip of the arm 5 such that the bucket 6 can be turned upward and downward. The boom 4, the arm 5, and the bucket 6 are hydraulically driven by a boom cylinder 7, an arm cylinder 8, and a bucket cylinder 9, respectively. The boom cylinder 7, the arm cylinder 8, and the bucket cylinder 9 serve as hydraulic actuators.

Further, a hook 80 for hoisting work (crane work) that uses the attachment is attached to the bucket 6 serving as an end attachment. The end of the hook 80 is pivotably connected to a bucket pin that connects the arm 5 and the bucket 6. This allows the hook 80 to be stored in a space formed between two bucket links when work other than hoisting work, such as excavation work, is performed.

The cabin 10 is a cab in which an operator is seated, and is mounted on the front left of the upper turning body 3.

The shovel 100 drives driven elements such as the lower traveling body 1 (left and right crawlers), the upper turning body 3, the boom 4, the arm 5, and the bucket 6 in accordance with the operation performed by the operator seated in the cabin 10.

The shovel 100 may be configured to be remotely operated by an external operator, instead of or in addition to the operator seated in the cabin 10. If the shovel 100 is remotely operated, the shovel 100 may be unattended. In the following description, an operation performed by an operator includes at least one of an operation performed by the operator in the cabin 10 with respect to an operating device 26 and a remote operation performed by an external operator.

A remote operation includes a mode in which the shovel 100 is operated by an operation input related to actuators of the shovel 100 and performed by an operator of a predetermined external device, for example. In this case, the shovel 100 transmits image information (a captured image), which is output by an image capturing device that captures an image of an area surrounding the upper turning body 3, to the external device. The image information may be displayed on a display device (hereinafter referred to as a "remote operation display device") provided in the external device. Further, various kinds of information images (information screens) displayed on a display device 50, which will be described later, provided in the cabin 10 of the shovel 100, may also be displayed on the remote operation display device of the external device. Accordingly, the operator of the external device can remotely operate the shovel 100 while checking the contents displayed on the remote operation display device, such as a captured image representing the situation surrounding the shovel 100, an information screen, and the like. The shovel 100 may operate the actuators in accordance with a remote operation signal indicating the details of the remote operation received from the external device, and drive the driven elements such as the lower traveling body 1 (left and right crawlers), the upper turning body 3, the boom 4, the arm 5, and the bucket 6.

In addition, the remote operation may include a mode in which the shovel 100 is operated by speech or a gesture input from outside by a person (for example, a worker) around the shovel 100. Specifically, the shovel 100 recognizes speech spoken by a worker around the shovel 100, a gesture performed by a worker, and the like through a speech input device (for example, a microphone), a gesture input device (for example, an image capturing device), and the like installed in the shovel 100. The shovel 100 may operate actuators so as to drive the driven elements such as the lower traveling body (left and right crawlers), the upper turning body 3, the boom 4, the arm 5, and the bucket 6 in accordance with the details of the recognized speech, gesture, and the like.

Further, the shovel 100 may automatically operate hydraulic actuators independent of the operator's operation. Accordingly, the shovel 100 can implement a function (hereinafter referred to as an "automatic operation function" or a "machine control function") to automatically operate at least some of the driven elements such as the lower traveling body 1 (left and right crawlers), the upper turning body 3, the boom 4, the arm 5, and the bucket 6.

The automatic operation function may include a function (what is known as a "semi-automatic operation function") to automatically operate driven elements (hydraulic actuators) other than a target driven element (hydraulic actuator) in response to the operator's operation with respect to the operating device 26 or the operator's remote operation. Further, the automatic operation function may include a function (what is known as a "fully automatic operation function") to automatically operate at least some of a plurality of driven elements (hydraulic actuators) without the operator's operation with respect to the operating device 26 or the operator's remote operation. When the fully automatic operation function is enabled, the shovel 100 may be unattended. In addition, each of the semi-automatic operation function, the fully automatic operation function, and the like may include a function in which an automatic operation of a driven element (hydraulic actuator) is automatically determined in accordance with predetermined rules. Further, each of the semi-automatic operation function, the fully automatic operation function, and the like may include a function (what is known as an "autonomous operation function") in which the shovel 100 autonomously makes various determinations, and an automatic operation of a driven element (hydraulic actuator) is determined in accordance with the determination results.

[Configuration of Shovel]

Next, a configuration of the shovel 100 will be described with reference to FIG. 2 in addition to FIG. 1.

Figure 2:
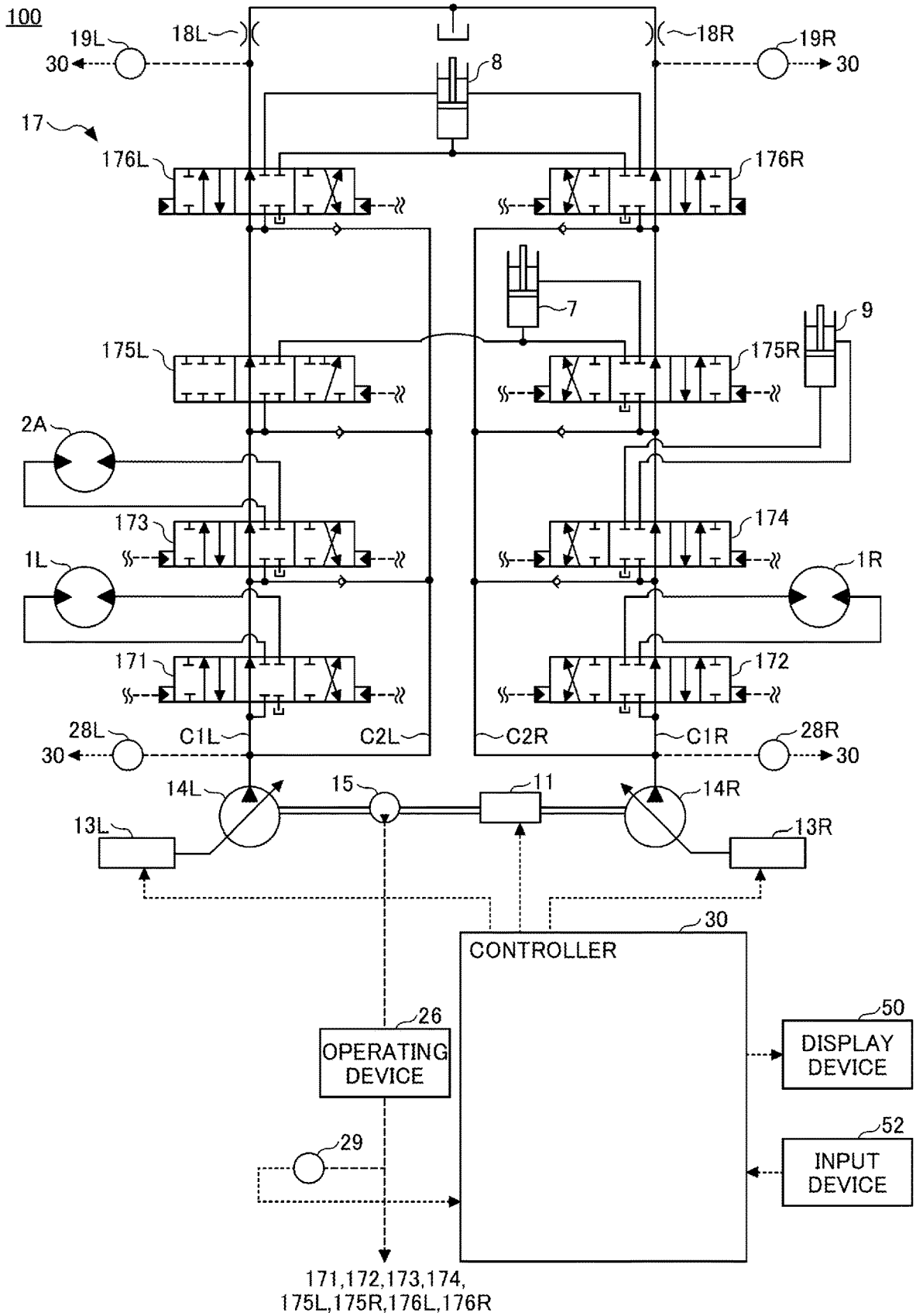
FIG. 2 is a diagram illustrating an example configuration of the shovel.

FIG. 2 is a diagram illustrating an example configuration of the shovel 100 according to the present embodiment.

In the drawing, a mechanical power line, a high-pressure hydraulic line, a pilot line, and an electric drive and control line are indicated by a double line, a continuous line, a dashed line, and a dotted line, respectively.

<Hydraulic Drive System>

A hydraulic drive system of the shovel 100 according to the present embodiment includes hydraulic actuators that hydraulically drive driven elements such as the lower traveling body 1, the upper turning body 3, the boom 4, the arm 5, and the bucket 6. The hydraulic actuators include the traveling hydraulic motors 1L and 1R, the turning hydraulic motor 2A, the boom cylinder 7, the arm cylinder 8, and the bucket cylinder 9. Further, the hydraulic drive system of the shovel 100 according to the present embodiment includes an engine 11, main pumps 14L and 14R, and a control valve 17.

The engine 11 is a main power source in the hydraulic drive system, and is mounted on the back of the upper turning body 3, for example. Specifically, the engine 11 rotates constantly at a preset target rotational speed as controlled by a controller 30 to drive the main pumps 14L and 14R and a pilot pump 15. The engine 11 is, for example, a diesel engine fueled with diesel fuel.

Similar to the engine 11, each of the main pumps 14L and 14R is, for example, mounted on the back of the upper turning body 3, and supplies hydraulic oil to the control valve 17 through a high-pressure hydraulic line. As described above, each of the main pumps 14L and 14R is driven by the engine 11. The main pumps 14L and 14R are, for example, variable displacement hydraulic pumps, and their discharge flow rates (discharge pressures) can be controlled by regulators 13L and 13R adjusting the tilt angles of the swash plates to adjust the stroke lengths of pistons, as controlled by the controller 30 as will be described later.

The control valve 17 is a hydraulic control device that is mounted in the center of the upper turning body 3, and controls the hydraulic drive system in accordance with the operator's operation (operation with respect to the operating device 26 or remote operation) for operating a driven element (corresponding hydraulic actuator) or in accordance with an operation command related to the automatic operation function for operating a driven element (corresponding hydraulic actuator). As described above, the control valve 17 is connected to the main pumps 14L and 14R via a high-pressure hydraulic line, and selectively supplies hydraulic oil supplied from the main pumps 14L and 14R to the traveling hydraulic motor 1L (for the left crawler), the traveling hydraulic motor 1R (for the right crawler), the turning hydraulic motor 2A, the boom cylinder 7, the arm cylinder 8, and the bucket cylinder 9, which are hydraulic actuators, in accordance with the state of the operator's operation (operation with respect to the operating device 26 or remote operation) related to a driven element or in accordance with the details of an operation command related to the automatic operation function for operating a driven element. Specifically, the control valve 17 includes control valves 171, 172, 173, 174, 175L, 175R, 176L, and 176R that control the flow rate and flow direction of hydraulic oil supplied from the main pumps 14L and 14R to the individual hydraulic actuators.

The hydraulic system of the shovel 100 circulates hydraulic oil from each of the main pumps 14L and 14R driven by the engine 11 to a hydraulic oil tank by way of center bypass oil conduits C1L and C1R or parallel oil conduits C2L and C2R.

The center bypass oil conduit C1L starts at the main pump 14L and ends at the hydraulic oil tank, passing through the control valves 171, 173, 175L, and 176L in this order in the control valve 17.

The center bypass oil conduit C1R starts at the main pump 14R and ends at the hydraulic oil tank, passing through the control valves 172, 174, 175R, and 176R in this order in the control valve 17.

The control valve 171 is a spool valve that supplies hydraulic oil discharged from the main pump 14L to the traveling hydraulic motor 1L and discharges hydraulic oil discharged by the traveling hydraulic motor 1L to the hydraulic oil tank.

The control valve 172 is a spool valve that supplies hydraulic oil discharged from the main pump 14R to the traveling hydraulic motor 1R and discharges hydraulic oil discharged by the traveling hydraulic motor 1R to the hydraulic oil tank.

The control valve 173 is a spool valve that supplies hydraulic oil discharged from the main pump 14L to the turning hydraulic motor 2A and discharges hydraulic oil discharged by the turning hydraulic motor 2A to the hydraulic oil tank.

The control valve 174 is a spool valve that supplies hydraulic oil discharged from the main pump 14R to the bucket cylinder 9 and discharges hydraulic oil in the bucket cylinder 9 to the hydraulic oil tank.

The control valves 175L and 175R are spool valves that supply hydraulic oil discharged by the main pumps 14L and 14R to the boom cylinder 7 and discharge hydraulic oil in the boom cylinder 7 to the hydraulic oil tank.

The control valves 176L and 176R are spool valves that supply hydraulic oil discharged by the main pumps 14L and 14R to the arm cylinder 8 and discharge hydraulic oil in the arm cylinder 8 to the hydraulic oil tank.

Each of the control valves 171, 172, 173, 174, 175L, 175R, 176L, and 176R controls the flow rate of hydraulic oil discharged from or supplied to a hydraulic actuator according to a pilot pressure acting on its pilot port.

The parallel oil conduit C2L supplies hydraulic oil from the main pump 14L to the control valves 171, 173, 175L, and 176L in parallel with the center bypass oil conduit C1L. Specifically, the parallel oil conduit C2L is configured to diverge from the center bypass oil conduit C1L upstream of the control valve 171 to make it possible to supply hydraulic oil from the main pump 14L to the control valves 171, 173, 175L and 176L in parallel. This enables the parallel oil conduit C2L to supply hydraulic oil to a control valve further downstream when the flow of hydraulic oil through the center bypass oil conduit C1L is restricted or blocked by any of the control valves 171, 173 and 175L.

The parallel oil conduit C2R supplies hydraulic oil from the main pump 14R to the control valves 172, 174, 175R, and 176R in parallel with the center bypass oil conduit C1R. Specifically, the parallel oil conduit C2R is configured to diverge from the center bypass oil conduit C1R upstream of the control valve 172 to make it possible to supply hydraulic oil from the main pump 14R to the control valves 172, 174, 175R and 176R in parallel. This enables the parallel oil conduit C2R to supply hydraulic oil to a control valve further downstream when the flow of hydraulic oil through the center bypass oil conduit C1R is restricted or blocked by any of the control valves 172, 174 and 175R.

<Operating System>

An operating system of the shovel 100 according to the present embodiment includes the pilot pump 15 and the operating device 26.

Similar to the engine 11, the pilot pump 15 is mounted, for example, on the back of the upper turning body 3, and applies a pilot pressure to the operating device 26 via a pilot line. The pilot pump 15 is, for example, a fixed displacement hydraulic pump and is driven by the engine 11 as described above.

The operating device 26 is an operation input unit provided near the operator's seat of the cabin 10 and used by the operator to operate various driven elements (such as the lower traveling body 1, the upper turning body 3, the boom 4, the arm 5, and the bucket 6). In other words, the operating device 26 is an operation input unit used by the operator to operate hydraulic actuators (such as the traveling hydraulic motors 1L and 1R, the turning hydraulic motor 2A, the boom cylinder 7, the arm cylinder 8, and the bucket cylinder 9) that drive respective driven elements. The operating device 26 includes, for example, respective four levers for operating the upper turning body 3, the boom 4, the arm 5, and the bucket 6. Furthermore, the operating device 26 includes, for example, respective two pedals for operating the left crawler and the right crawler of the lower traveling body 1 (that is, the traveling hydraulic motors 1L and 1R).

As illustrated in FIG. 2, the operating device 26 is, for example, of a hydraulic pilot type, and outputs hydraulic oil having a pilot pressure corresponding to its operation details. Specifically, each of the levers, the pedals, and the like included in the operating device 26 is connected to the control valve 17 via a pilot line, and uses hydraulic oil supplied from the pilot pump 15 to output a pilot pressure, corresponding to its operation details, to the control valve 17. Accordingly, pilot signals (pilot pressures) corresponding to the operating states of the lower traveling body 1, the upper turning body 3, the boom 4, the arm 5, the bucket 6, and the like in the operating device 26 are input into the control valve 17. Specifically, pilot pressures on the secondary side of the two pedals for operating the left crawler (traveling hydraulic motor 1L) and the right crawler (traveling hydraulic motor 1R) act on pilot ports of the control valves 171 and 172, respectively. Further, a pilot pressure on the secondary side of a lever for operating the upper turning body 3 (turning hydraulic motor 2A) acts on a pilot port of the control valve 173. Further, a pilot pressure on the secondary side of a lever for operating the boom 4 (boom cylinder 7) acts on pilot ports of the control valves 175L and 175R. Further, a pilot pressure on the secondary side of a lever for operating the arm 5 (arm cylinder 8) acts on pilot ports of the control valves 176L and 176R. Further, a pilot pressure on the secondary side of a lever for operating the bucket 6 (bucket cylinder 9) acts on a pilot port of the control valve 174. Therefore, the control valve 17 can selectively drive the hydraulic actuators in accordance with the operating states in the operating device 26.

The operating device 26 may be of an electrical type, and may output an electrical signal (hereinafter referred to as an "operation signal") corresponding to its operation details. In this case, the operation signal from the operating device 26 is input to the controller 30, and the controller 30 controls control valves in the control valve 17 in accordance with the input operation signal, thereby achieving the operations of various hydraulic actuators in accordance with the operation details of the operating device 26. For example, the control valves in the control valve 17 may be electromagnetic solenoid spool valves driven by a command from the controller 30. Further, for example, a hydraulic control valve (hereinafter referred to as an "operation control valve") that operates in response to a control command from the controller 30 may be placed between the pilot pump 15 and a pilot port of each control valve. In this case, when the operating device 26 of an electric type is manually operated, the controller 30 can operate each control valve in accordance with the operation details of the operating device 26 by controlling the operation control valve to increase or decrease a pilot pressure with a control command corresponding to the amount of operation (for example, the amount of lever operation).

<Control System>

A control system of the shovel 100 according to the present embodiment includes the controller 30. Further, the control system of the shovel 100 according to the present embodiment includes regulators 13L and 13R, negative control throttles (hereinafter referred to as "NC throttles") 18L and 18R, negative control (NC) pressure sensors 19L and 19R, discharge pressure sensors 28, an operating pressure sensor 29, the display device 50, and an input device 52.

The controller 30 (an example of a "control device") performs various kinds of control for the shovel 100. The functions of the controller 30 may be implemented by desired hardware, a combination of desired hardware and desired software, or the like. For example, the controller 30 includes circuitry constituted mainly of a computer that includes a central processing unit (CPU), a memory unit such as a random-access memory (RAM), a secondary storage such as a read-only memory (ROM), and various input/output interfaces. The controller 30 implements various functions by executing, on the CPU, one or more programs stored in the secondary storage, for example.

For example, the controller 30 sets a target rotational speed based on a work mode (such as a "lifting mode" described below) or the like preset by the operator's operation or the like, and performs drive control that rotates the engine 11 at a constant speed via a control device dedicated to the engine 11. In the shovel 100, a normal mode, in which normal work such as excavation work is performed, and a work mode corresponding to hoisting work involving use of the attachment (the hook 80) (hereinafter referred to as the "lifting mode") may be predefined and selectable by the operator's operation or the like through the input device 52. If the lifting mode is selected, the controller 30 sets the target rotational speed of the engine 11 to be relatively low. As a result, the movement of the attachment becomes relatively slow during hoisting work. Therefore, the operator can easily perform a hoisting operation.

Further, for example, the controller 30 controls the discharge quantities of the main pumps 14L and 14R by controlling the regulators 13L and 13R and adjusting the tilt angles of the swash plates of the main pumps 14L and 14R.

Specifically, the controller 30 may control the discharge quantities of the main pumps 14L and 14R by controlling the regulators 13L and 13R according to the discharge pressures of the main pumps 14L and 14R detected by the discharge pressure sensors 28L and 28R. More specifically, in response to an increase in the discharge pressure of the main pump 14L, the controller 30 may decrease the discharge quantity of the main pump 14L by controlling the regulator 13L to adjust the tilt angle of the swash plate of the main pump 14L. The same applies to the regulator 13R. This enables the controller 30 to perform full power control on the main pumps 14L and 14R such that the absorbed power of the main pumps 14L and 14R expressed as the product of discharge pressure and discharge quantity is prevented from exceeding the output power of the engine 11.

Further, the controller 30 may control the discharge quantities of the main pumps 14L and 14R by controlling the regulators 13L and 13R in accordance with detection signals corresponding to control pressures (hereinafter referred to as "negative control (NC) pressures") generated by the NC throttles 18L and 18R. The detection signals corresponding to the NC pressures are input by the NC pressure sensors 19L and 19R. More specifically, the controller 30 decreases the discharge quantities of the main pumps 14L and 14R as the NC pressures increase, and increases the discharge quantities of the main pumps 14L and 14R as the NC pressures decrease.

In a standby state in which none of the hydraulic actuators is operated in the shovel 100 (the state illustrated in FIG. 2), hydraulic oil discharged from the main pumps 14L and 14R arrive at the NC throttles 18L and 18R through the center bypass oil conduits C1L and C1R. The flow of hydraulic oil discharged from the main pumps 14L and 14R increases the NC pressures generated upstream of the NC throttles 18L and 18R. As a result, the controller 30 decreases the discharge quantities of the main pumps 14L and 14R to a minimum allowable discharge quantity so as to reduce pressure loss (pumping loss) during the passage of the discharged hydraulic oil through the center bypass oil conduits C1L and C1R.

Conversely, when any hydraulic actuator is operated by the operating device 26, hydraulic oil discharged from the main pump 14L or 14R flows into the operated hydraulic actuator via a control valve corresponding to the operated hydraulic actuator. The flow of hydraulic oil discharged from the main pump 14L or 14R that arrives at the NC throttle 18L or 18R is reduced in amount or lost, and the control pressure generated upstream of the NC throttle 18L or 18R is reduced. As a result, the controller 30 can increase the discharge quantity of the main pump 14L or 14R and circulate sufficient hydraulic oil to the operated hydraulic actuator so as to securely drive the operated hydraulic actuator.

Accordingly, the controller 30 can reduce unnecessary energy consumption in the standby state of the hydraulic drive system. The unnecessary energy consumption includes pumping loss caused by hydraulic oil discharged by the main pumps 14L and 14R in the center bypass oil conduits C1L and C1R. Further, when any hydraulic actuator is operated, the controller 30 can supply necessary and sufficient hydraulic oil from the main pump 14L or the main pump 14R to the operated hydraulic actuator.

Further, for example, when the operating device 26 is of an electric type, the controller 30 controls an operation proportional valve to achieve the operation of a hydraulic actuator in accordance with the operation details of the operating device 26 as described above.

Further, for example, the controller 30 uses the operation proportional valve to achieve the remote operation of the shovel 100. Specifically, the controller 30 may output a control command corresponding to the details of a remote operation to the operation proportional valve. The details of the remote operation are specified by a remote operation signal transmitted from an external device, or are specified by speech, a gesture, or the like input by a person around the shovel 100. Then, the operation proportional valve may use hydraulic oil supplied from the pilot pump 15 to output a pilot pressure corresponding to the control command from the controller 30, and cause the pilot pressure to act on a pilot port of a corresponding control valve in the control valve 17. Accordingly, the details of the remote operation are reflected in the operation of the control valve 17, thereby allowing hydraulic actuators to move various operated elements (driven element) in accordance with the details of the remote operation.

Further, for example, the controller 30 uses the operation proportional valve to implement the automatic operation function of the shovel 100. Specifically, the controller 30 may output a control command, corresponding to an operation command related to the automatic operation function, to the operation proportional valve. The operation command may be generated by the controller 30 or generated by another control device that performs control related to the automatic operation function. The operation proportional valve may use hydraulic oil supplied from the pilot pump 15 to output a pilot pressure corresponding to the control command from the controller 30, and cause the pilot pressure to act on a pilot port of a corresponding control valve in the control valve 17. Accordingly, the details of the operation command related to the automatic operation function are reflected in the operation of the control valve 17, thereby allowing hydraulic actuators to move various operated elements (driven element) in accordance with the automatic operation function.

Further, for example, the controller 30 monitors the entry of a predetermined target (hereinafter referred to as a "monitoring target") into an area in proximity to the shovel 100 (hereinafter referred to as a "monitoring area"). Examples of the monitoring target include persons such as workers and supervisors at a work site. In addition, examples of the monitoring target may include any obstacles other than persons, such as materials temporarily placed at a work site, stationary obstacles (such as a temporary office placed at a work site), and moving obstacles (such as vehicles including trucks). Specifically, the controller 30 may detect a monitoring target in the monitoring area in the vicinity of the shovel 100 based on information obtained by a surrounding information obtaining device installed in the shovel 100. Further, if a monitoring target is detected in the monitoring area, the controller 30 may determine (identify) the position of the monitoring target based on the information obtained by the surrounding information obtaining device.

The surrounding information obtaining device obtains information representing a situation around the shovel 100. For example, the surrounding information obtaining device may include an image capturing device that obtains image information around the shovel 100. The image capturing device includes, for example, a monocular camera, a stereo camera, a depth camera, a distance image sensor, and the like. For example, the surrounding information obtaining device may include a distance sensor capable of obtaining information related to the distance between the shovel 100 and an object around the shovel 100. The distance sensor may be lidar (Light Detecting and Ranging), a millimeter wave radar, or an ultrasonic sensor.

Further, if a monitoring target is detected in the monitoring area around the shovel 100, the controller 30 may notify the operator of the shovel 100 or workers around the shovel 100 that the monitoring target is detected. Specifically, if a monitoring target is detected in the monitoring area around the shovel 100, the controller 30 may use a sound output device installed in the shovel 100 to output an audible alarm toward the interior of the cabin 10 and the surroundings of the shovel 100. The sound output device includes, for example, a speaker, a buzzer, and the like. Further, if a monitoring target is detected in the monitoring area around the shovel 100, the controller 30 may use a display device and an illumination device installed in the shovel 100 to output a visual alarm toward the interior of the cabin 10 and the surroundings of the shovel 100. In this manner, the shovel 100 can cause workers around the shovel 100 to recognize the presence of the monitoring target in the area in proximity to the shovel 100, and to evacuate the area in proximity to the shovel 100. Accordingly, the safety of the shovel 100 can be improved.

Further, if a monitoring target is detected in the monitoring area around the shovel 100, the controller 30 may restrict the movement of the shovel 100, irrespective of the operator's operation or the details of an operation command related to the automatic operation function. Restricting the movement of the shovel 100 includes causing the movement of the shovel 100 to be slower than that in the normal state. Specifically, the controller 30 may restrict the movement of the shovel 100 by controlling a gate lock valve provided in a pilot line between the pilot pump 15 and the operating device 26 to reduce a pilot pressure applied to the operating device 26. Further, the controller 30 may restrict the movement of the shovel 100 by controlling a pressure reducing valve provided in a pilot line between the operating device 26 and the control valve 17 to reduce a pilot pressure acting on a pilot port of the control valve 17. If the operating device 26 is of an electric type, the controller 30 may restrict the movement of the shovel 100 by controlling the operation proportional valve such that a pilot pressure output from the operation proportional valve is less than the value specified by an operation signal. Accordingly, the safety of the shovel 100 can be improved.

Further, the controller 30 sets the standby flow rate of a main pump 14 to be greater when hoisting work involving use of the attachment is performed than when work other than the hoisting work, that is, normal work (such as excavation work) is performed. The standby flow rate of the main pump 14 is, for example, the flow rate of the main pump 14 when a hydraulic actuator is not operated or starts to be operated. That is, the standby flow rate of the main pump 14 is the lower limit value of the flow rate of the main pump 14. For example, when the lifting mode is selected through the input device 52, the controller 30 sets the standby flow rate of the main pump 14 to be relatively greater than when the normal mode is selected. A control method will be described later in detail (see FIG. 3).

Note that some of the functions of the controller 30 may be implemented by another controller. That is, the functions of the controller 30 may be implemented by being distributed over a plurality of controllers.

The regulators 13L and 13R adjust the discharge quantities of the main pumps 14L and 14R by adjusting the tilt angles of the swash plates of the main pumps 14L and 14R, respectively, as controlled by the controller 30.

The NC throttles 18L and 18R are provided between the most downstream control valves 176L and 176R and the hydraulic oil tank in the center bypass oil conduits C1L and C1R, respectively. Accordingly, the flow of hydraulic oil discharged by the main pumps 14L and 14R is restricted by the NC throttles 18L and 18R, and the NC throttles 18L and 18R generate NC pressures as described above.

The NC pressure sensors 19L and 19R detect the NC pressures, and detection signals corresponding to the detected NC pressures are input into the controller 30.

The discharge pressure sensors 28L and 28R detect the discharge pressures of the main pumps 14L and 14R, respectively, and detection signals corresponding to the detected discharge pressures are input into the controller 30.

The operating pressure sensor 29 detects the secondary-side pilot pressure of the operating device 26, that is, pilot pressures commensurate with the operating states of driven elements (hydraulic actuators) in the operating device 26. Detection signals of the pilot pressures commensurate with the operating states of the lower traveling body 1, the upper turning body 3, the boom 4, the arm 5, the bucket 6, and the like in the operating device 26 are generated by the operating pressure sensor 29 and input into the controller 30.

If the operating device 26 is of an electric type, the operating pressure sensor 29 is omitted. This is because the controller 30 can ascertain the operating state of the operating device 26 based on the details of an operation signal output from the operating device 26.

The display device 50 is provided at a location near the operator's seat inside the cabin 10 (for example, a pillar portion at the front right inside the cabin 10) so as to be easily visible by the operator, and displays various information screens as controlled by the controller 30. The display device 50 is a liquid crystal display or an organic electroluminescent (EL) display, for example, and may be a touch-screen panel integrally including an operating unit.

The input device 52 is provided within the reach of the operator or the like seated in the cabin 10, and receives various operations by the operator or the like. The input device 52 includes, for example, an operation input device configured to receive an operation input by the operator or the like. The operation input device may include a touch panel attached to a display of the display device 50 configured to display various information images, a touchpad provided separately from the display of the display device 50, a knob switch provided at the end of a lever portion of a lever included in the operating device 26, and a button switch, a lever, a toggle, a dial, and the like provided in the vicinity of the display device 50 or provided at a location relatively apart from the display device 50. Further, the input device 52 includes the speech input device configured to receive speech input by the operator or the like. The speech input device includes, for example, a microphone. Further, the input device 52 includes the gesture input device configured to receive a gesture input by the operator or the like. The gesture input device includes, for example, an image capturing device capable of capturing an image of a gesture performed by the operator or the like in the cabin 10. A signal corresponding to the input contents received by the input device 52 is input into the controller 30.

[Details of Control Method for Main Pump]

Next, a method for controlling the main pump 14 by the controller 30 will be described in detail with reference to FIG. 3 through FIG. 5.

Figure 3:
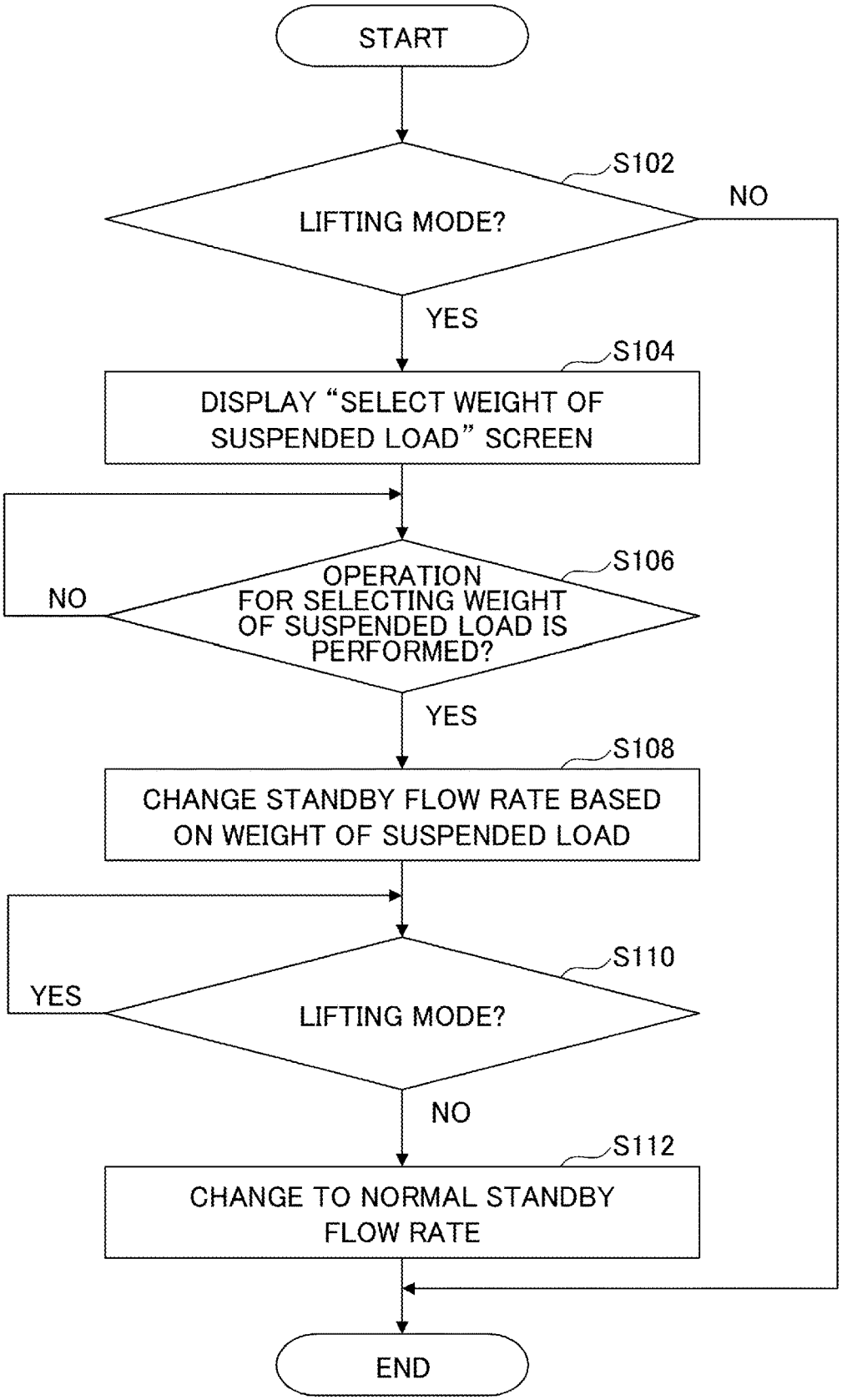
FIG. 3 is a flowchart schematically illustrating an example of a control process by a controller.

FIG. 3 is a flowchart schematically illustrating an example of a process for controlling the main pump 14 by the controller 30. For example, the process represented by the flowchart is repeatedly executed at predetermined processing intervals when the lifting mode is not selected, that is, when the normal mode is selected.

In step S102, the controller 30 determines whether the shovel 100 is performing hoisting work. In this example, the controller 30 determines whether the lifting mode is selected. If the lifting mode is selected, the controller 30 proceeds to step S104. If the lifting mode is not selected, the controller 30 ends the current process.

In step S102, the controller 30 may determine whether the shovel 100 is performing as described below. For example, the controller 30 may determine whether hoisting work is performed based on the operation details of the operating device 26 or the measured value of a sensor configured to detect the pressure of the boom cylinder 7 (hereinafter referred to as a "boom cylinder pressure sensor"). Specifically, the controller 30 may determine that hoisting work is performed when it can be determined that a certain weight of a load is suspended based on the measured pressure value of the boom cylinder 7 and also it can be assumed that the operating device 26 is operated based on the operation details for hoisting work. Further, the controller 30 may determine whether hoisting work is performed by identifying the movement of the attachment or the details of work, based on an image captured by the image capturing device, which is configured to capture an image in front of the upper turning body 3.

In step S104, the controller 30 displays, on the display device 50, an operation screen that allows the operator to select a weight class to which the weight of a suspended load belongs, from among predefined weight classes (hereinafter referred to as a "Select Weight of Suspended Load" screen). Then, the controller 30 proceeds to step S106.

Figure 4:
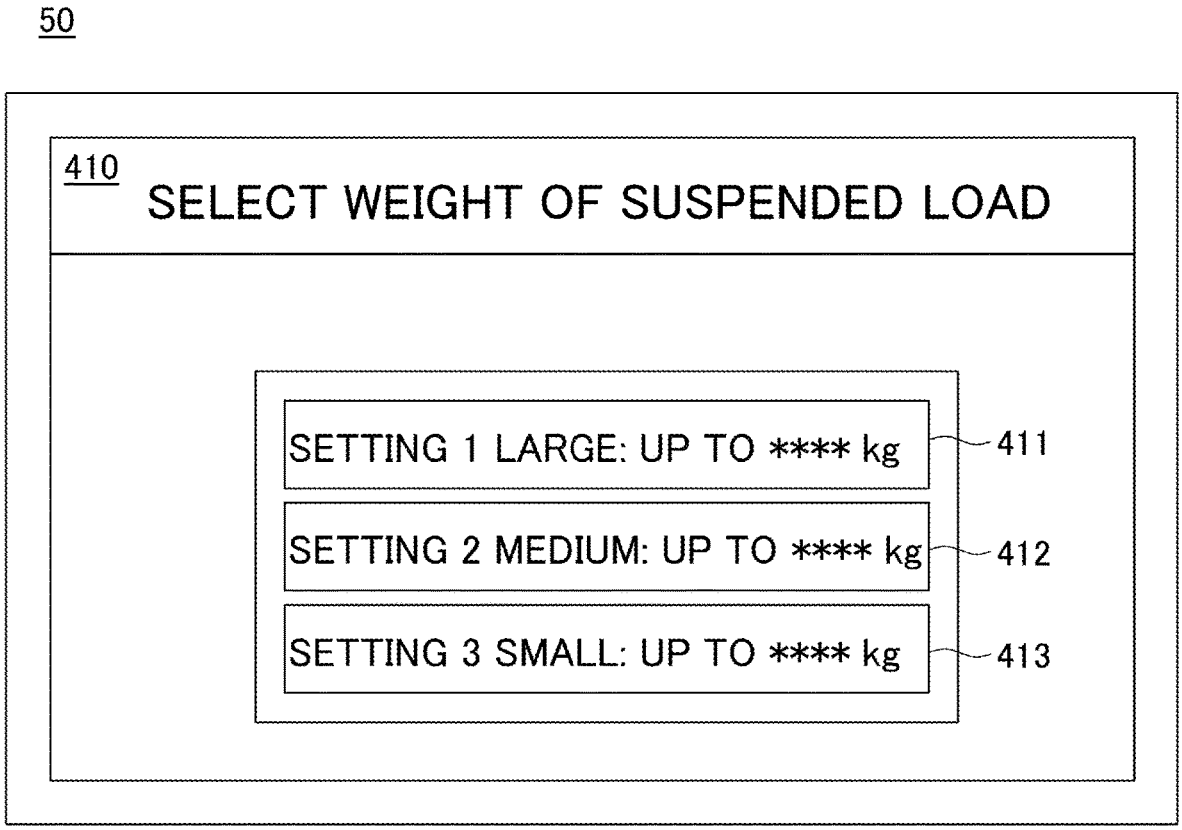
FIG. 4 is a diagram illustrating an example of a "Select Weight of Suspended Load" screen.

For example, FIG. 4 is a diagram illustrating an example of the "Select Weight of Suspended Load" screen (a "Select Weight of Suspended Load" screen 410) displayed on the display device 50.

The "Select Weight of Suspended Load" screen 410 displays a relatively large (heavy) weight class ("setting 1 large"), a medium weight class ("setting 2 medium"), and a relatively small (light) weight class ("setting 3 small"), and icons 411 to 413 for selecting the respective weight classes. The operator or the like can select any one of the icons 411 to 413 through the input device 52 such that the corresponding weight class can be selected.

Referring back to FIG. 3, in step S106, the controller 30 determines whether an operation for selecting the weight of the suspended load is performed. If an operation for selecting the weight of the suspended load is performed on the "Select Weight of Suspended Load" screen 410 through the input device 52, the controller 30 proceeds to step S108. If an operation for selecting the weight of the suspended load is not performed, the controller 30 waits until the operation is performed.

In step S104 of FIG. 3, instead of displaying the "Select Weight of Suspended Load" screen 410, the controller 30 may display an operation screen allowing the operator to input a specific value of the weight of the suspended load through the input device 52. Alternatively, the controller 30 may estimate the weight of the suspended load, based on detection information related to the orientation state of the attachment and the pressure value measured by the boom cylinder pressure sensor. In this case, steps S104 and S106 are skipped. Further, in step S106, if an operation for selecting the weight of the suspended load is not performed for a certain period of time, the controller 30 may automatically assume that the smallest (lightest) weight class is selected, and may proceed to step S108.

In step S108, the controller 30 changes the standby flow rate of the main pump 14 based on the weight of the suspended load, specifically the weight class of the suspended load selected on the "Select Weight of Suspended Load" screen 410. Then, the controller 30 proceeds to step S110.

Figure 5:
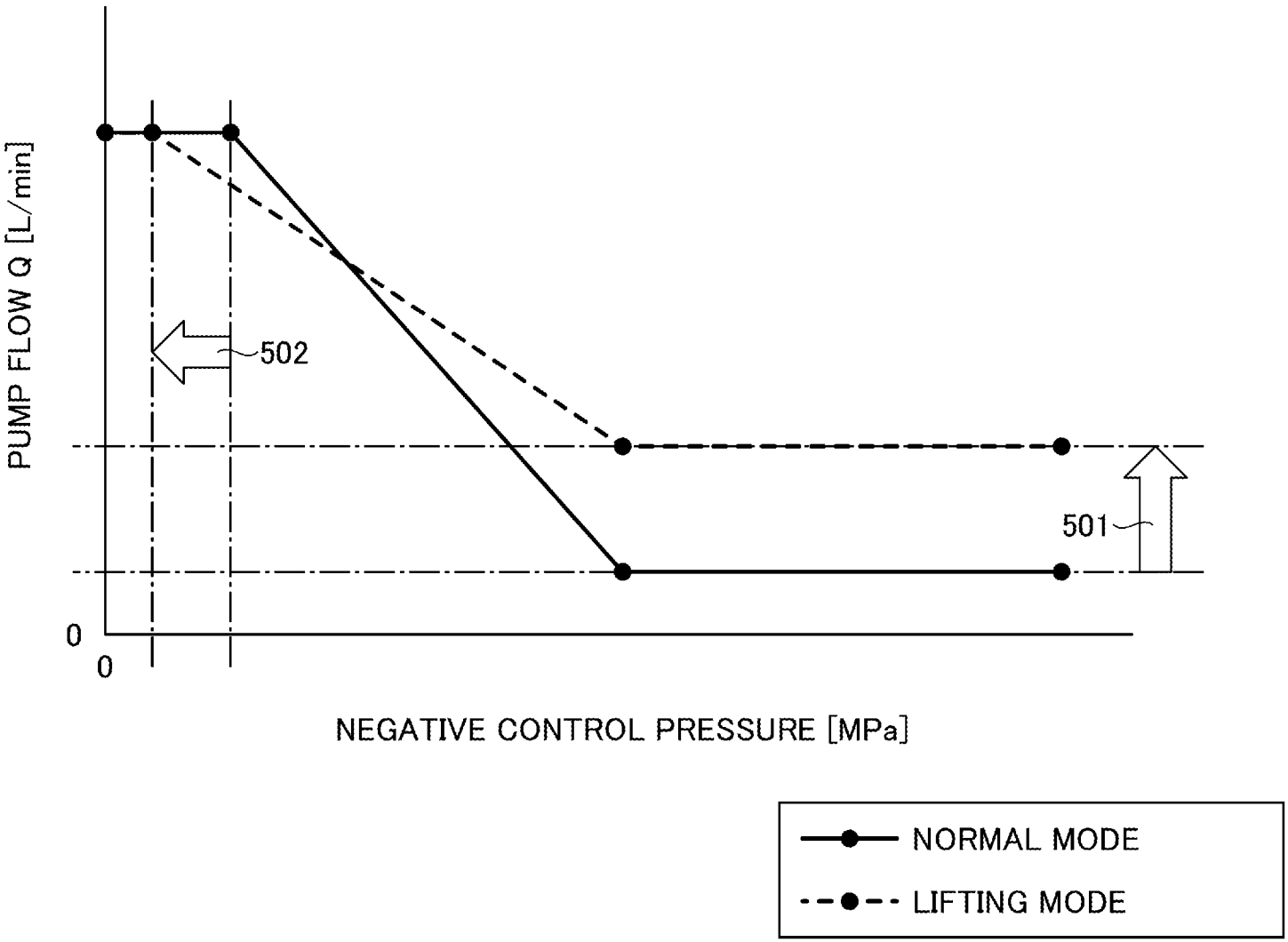
FIG. 5 is a diagram illustrating an example of negative control pressure characteristics.

For example, FIG. 5 is a diagram illustrating the relationship between the amount of operation of a hydraulic actuator (horizontal axis) and the discharge quantity of the main pump 14 (vertical axis) in the case of the normal mode and the lifting mode. Specifically, FIG. 5 is a diagram illustrating the relationship between an NC pressure (horizontal axis) and the discharge quantity of the main pump 14 per unit time (for example, per minute) (vertical axis) in the case of the normal mode and the lifting mode.

As illustrated in FIG. 5, the controller 30 increases the standby flow rate when the lifting mode is selected as compared to when the normal mode is selected (as indicated by an arrow 501 in FIG. 5).

Accordingly, the discharge pressure of the main pump 14 rises relatively quickly when the boom cylinder 7 or the arm cylinder 8 starts to be operated, thereby improving the responsiveness of the attachment when a hoisting operation is started. Therefore, the operator can perform an inching operation during hoisting work even in an area where the amount of operation of the operating device 26 is small.

Further, when the lifting mode is selected, the controller 30 may increase the standby flow rate of the main pump 14 as the size (weight) of the suspended load increases. Accordingly, even when the suspended load is relatively large (heavy), the discharge pressure of the main pump 14 can rise relatively quickly when an operation is started, as with the case of a relatively small (light) suspended load.

Further, in this example, the controller 30 sets a change in the flow rate of the main pump 14 with respect to a change in the amount of a hoisting operation (that is, the amount of operation of one or both of the boom cylinder 7 and the arm cylinder 8) (namely, the slope of the graph where the discharge quantity of the main pump 14 per unit time increases as the NC pressure decreases) to be smaller when the lifting mode is selected than when the normal mode is selected. Specifically, as illustrated in FIG. 5, while the value of the NC pressure at which the discharge quantity of the main pump 14 per unit time starts to increase in lifting mode remains the same as that in normal mode, the value of the NC pressure at which the discharge quantity of the main pump 14 per unit time reaches the maximum value is reduced (as indicated by an arrow 502 in FIG. 5). Accordingly, the accuracy and operability of the shovel 100 during hoisting work can be improved.

Further, the controller 30 may set the standby flow rate of one of the main pumps 14L and 14R to be greater when the lifting mode is selected than when the normal mode is selected. The main pumps 14L and 14R supply hydraulic oil to the boom cylinder 7 and the arm cylinder 8 that drive the attachment. In this case, the controller 30 may increase the standby flow rate of the main pump 14R only, which is different from the main pump 14L that supplies hydraulic oil to the turning hydraulic motor 2A. Accordingly, because the standby flow rate of the main pump 14L remains the same as that in normal mode, a situation in which in response to a turning operation, the upper turning body 3 is moved faster than expected by the operator due to an increase in the standby flow rate can be avoided.

Further, the controller 30 may set the standby flow rate of the main pump 14R, of the main pumps 14L and 14R, to be greater when the lifting mode is selected than when the normal mode is selected, and upon the travel operation of the lower traveling body 1 being performed, the controller 30 may temporarily decrease the standby flow rate of the main pump 14R, that is, change the standby flow rate of the main pump 14R to that in normal mode. The left and right crawlers of the lower traveling body 1 are driven by the traveling hydraulic motors 1L and 1R, respectively, and hydraulic oil is supplied from the main pumps 14L and 14R to the traveling hydraulic motors 1L and 1R, respectively. Therefore, if only the standby flow rate of the main pump 14R is relatively increased, there would be a possibility that the lower traveling body 1 is unable to travel properly (for example, unable to travel forward properly).

Further, when the lifting mode is selected, the controller 30 may increase the standby flow rates of both the main pumps 14L and 14R, and may temporarily decrease the standby flow rates of the main pumps 14L and 14R upon a turning operation being performed. Accordingly, the standby flow rates of both the main pumps 14L and 14R that drive the attachment can be increased during hoisting work, while also avoiding a situation in which the turning body 3 turns faster than expected by the operator in response to a turning operation.

Referring back to FIG. 3, in step S110, the controller 30 determines whether the lifting mode remains selected. If the lifting mode is no longer selected, that is, the lifting mode is cancelled and is switched to the normal mode, the controller 30 proceeds to step S112. Conversely, if the lifting mode remains selected, the controller 30 waits (repeats step S110) until the lifting mode is cancelled, that is, until the operating mode returns to the normal mode.

In step S112, the controller 30 changes the standby flow rate in lifting mode to that in normal mode. That is, the controller 30 relatively decreases the standby flow rate as compared to when the lifting mode is selected, and ends the current process.

Modifications and Variations

Although the embodiments have been specifically described above, the present disclosure is not limited to the specific embodiments, and various modifications and variations may be made without departing from the scope of the present invention set forth in the claims.

For example, in the above-described embodiments, the shovel 100 is configured to hydraulically drive all of various driven elements such as the lower traveling body 1, the upper turning body 3, the boom 4, the arm 5, and the bucket 6, but the shovel 100 may be configured to electrically drive some of the driven elements. That is, a configuration and the like disclosed in the above-described embodiments may also be applied to hybrid shovels, electrically powered shovels, and the like.

What is claimed is:

1. A shovel comprising:

a lower traveling body;

an upper turning body turnably mounted on the lower traveling body;

an attachment including a boom and an arm, the boom being attached to the upper turning body, and the arm being attached to a tip of the boom;

a boom cylinder configured to drive the boom;

an arm cylinder configured to drive the arm;

a hydraulic pump configured to supply hydraulic oil to the boom cylinder and the arm cylinder;

an input device configured to receive an input from a user; and processing circuitry configured to control the hydraulic pump, wherein the processing circuitry is configured to, when a lifting mode that is a work mode corresponding to hoisting work involving use of the attachment is selected in response to the input received by the input device, set a standby flow rate of the hydraulic pump to be greater than when a normal mode is selected, the normal mode being a work mode for performing work other than the hoisting work, the work other than the hoisting work including excavation work.

2. The shovel according to claim 1, wherein the processing circuitry is configured to increase the standby flow rate of the hydraulic pump as a weight of a suspended load increases, when the lifting mode is selected.

3. The shovel according to claim 1, wherein the processing circuitry is configure to set, when the lifting mode is selected, an amount of increase in the standby flow rate of the hydraulic pump with respect to the standby flow rate of the hydraulic pump when the normal mode is selected, based on the input with respect to a weight of a suspended load received by the input device.

4. The shovel according to claim 1, wherein the hydraulic pump includes a first pump and a second pump, the first pump being configured to supply hydraulic oil to the boom cylinder and the arm cylinder, and the second pump being different from the first pump, and wherein the processing circuitry is configured to, when the lifting mode is selected, set a standby flow rate of only the first pump between the first pump and the second pump to be greater than when the normal mode is selected.

5. The shovel according to claim 4, wherein the second pump is configured to supply hydraulic oil to a turning hydraulic motor configured to drive the upper turning body.

6. The shovel according to claim 4, wherein the first pump is configured to supply hydraulic oil to a first traveling hydraulic motor configured to drive a first crawler of the lower traveling body, and the second pump is configured to supply hydraulic oil to a second traveling hydraulic motor configured to drive a second crawler of the lower traveling body, and wherein the processing circuitry is configured to decrease the standby flow rate of the first pump upon an operation relating to the lower traveling body being performed, when the lifting mode is selected.

7. The shovel according to claim 1, wherein the processing circuitry is configured to, when the lifting mode is selected, set a change in a flow rate of the hydraulic pump with respect to a change in an operation amount of one or both of the boom cylinder and the arm cylinder to be smaller than when the normal mode is selected.

8. The shovel according to claim 1, wherein the processing circuitry is configured to, when the lifting mode is selected, set a negative control pressure at which a discharge quantity of the hydraulic pump per unit time reaches a maximum value to be smaller than when the normal mode is selected.

9. A shovel comprising:

a lower traveling body;

an upper turning body turnably mounted on the lower traveling body;

an attachment including a boom and an arm, the boom being attached to the upper turning body, and the arm being attached to a tip of the boom;

a boom cylinder configured to drive the boom;

an arm cylinder configured to drive the arm;

a hydraulic pump configured to supply hydraulic oil to the boom cylinder and the arm cylinder;

an input device configured to receive an input from a user; and processing circuitry configured to control the hydraulic pump, wherein the processing circuitry is configured to, when a lifting mode that is a work mode corresponding to hoisting work involving use of the attachment is selected in response to the input received by the input device, set a standby flow rate of the hydraulic pump to be greater than when a normal mode is selected and set a negative control pressure at which a discharge quantity of the hydraulic pump per unit time reaches a maximum value to be smaller than when the normal mode is selected, the normal mode being a work mode for performing work other than the hoisting work.

* * * * *